US009175574B2

(12) United States Patent
Milne

(10) Patent No.: US 9,175,574 B2
(45) Date of Patent: Nov. 3, 2015

(54) GUIDE VANE WITH A WINGLET FOR AN ENERGY CONVERTING MACHINE AND MACHINE FOR CONVERTING ENERGY COMPRISING THE GUIDE VANE

(75) Inventor: Trevor Milne, Sheffield (GB)

(73) Assignee: SIEMENS AKTIENGESELLSCHAFT, München (DE)

( * ) Notice: Subject to any disclaimer, the term of this patent is extended or adjusted under 35 U.S.C. 154(b) by 766 days.

(21) Appl. No.: 13/516,299

(22) PCT Filed: Aug. 23, 2010

(86) PCT No.: PCT/EP2010/062234

§ 371 (c)(1),
(2), (4) Date: Jun. 15, 2012

(87) PCT Pub. No.: WO2011/072892

PCT Pub. Date: Jun. 23, 2011

(65) Prior Publication Data

US 2012/0269623 A1 Oct. 25, 2012

(30) Foreign Application Priority Data

Dec. 16, 2009 (EP) ..... 09015576

(51) Int. Cl.
*F01D 9/04* (2006.01)
*F01D 5/20* (2006.01)
(Continued)

(52) U.S. Cl.
CPC ..... *F01D 9/041* (2013.01); *F01D 5/141* (2013.01); *F01D 5/20* (2013.01); *F01D 11/005* (2013.01); *F01D 17/162* (2013.01); *F04D 29/083* (2013.01); *F04D 29/164* (2013.01); *F04D 29/542* (2013.01); *F04D 29/544* (2013.01);
(Continued)

(58) Field of Classification Search
CPC ..... F01D 9/02; F01D 9/04; F01D 9/042; F01D 5/20; F01D 5/141; F01D 11/00; F01D 11/001; F01D 11/08; F04D 29/542; F04D 29/544; F05D 2240/125
See application file for complete search history.

(56) References Cited

U.S. PATENT DOCUMENTS 2,245,237 A * 6/1941 Truex ..... 415/209.4
3,193,185 A * 7/1965 Erwin et al. ..... 415/193
(Continued)

FOREIGN PATENT DOCUMENTS

DE 815971 C 10/1951
DE 19913269 A1 9/2000
(Continued)

OTHER PUBLICATIONS

Ebmpapst, "Fan blades with winglets for quiet fans" ehrnpapst. pp. 23-25.

*Primary Examiner* — Dwayne J White
*Assistant Examiner* — Joshua R Beebe

(57) ABSTRACT

An energy converting machine includes a guide vane. The guide vane includes a guide vane body for guiding a streaming fluid. The guide vane body has a pressure surface and a suction surface, a trailing edge and a leading edge, and a winglet for reducing leakage of the streaming fluid from the pressure surface to the suction surface. The winglet is arranged at a longitudinal end of the guide vane body. The winglet extents from the trailing edge to the leading edge and is arranged at the pressure surface. The winglet is free of protrusions beyond the leading edge and beyond the trailing edge.

18 Claims, 4 Drawing Sheets

(51) Int. Cl.

| | |
|---|---|
| ***F04D 29/54*** | (2006.01) |
| ***F01D 5/14*** | (2006.01) |
| ***F01D 11/00*** | (2006.01) |
| ***F01D 17/16*** | (2006.01) |
| ***F04D 29/08*** | (2006.01) |
| ***F04D 29/56*** | (2006.01) |
| ***F04D 29/16*** | (2006.01) |

(52) U.S. Cl.
CPC ..... *F04D 29/563* (2013.01); *F05D 2240/12* (2013.01); *F05D 2240/55* (2013.01)

(56) References Cited

U.S. PATENT DOCUMENTS

| | | | | | |
|---|---|---|---|---|---|
| 3,588,005 | A | * | 6/1971 | Rethorst | 244/200 |
| 3,908,361 | A | * | 9/1975 | Gardiner | 60/799 |
| 4,128,363 | A | * | 12/1978 | Fujikake et al. | 416/236 A |
| 4,768,922 | A | | 9/1988 | Kozak | |
| 4,804,905 | A | * | 2/1989 | Ding et al. | 324/662 |
| 5,161,947 | A | * | 11/1992 | Eckfeldt et al. | 415/211.2 |
| 6,283,705 | B1 | * | 9/2001 | Rice et al. | 415/160 |
| 6,565,324 | B1 | * | 5/2003 | Phillipsen et al. | 416/236 R |
| 2003/0077172 | A1 | | 4/2003 | Belady | |
| 2004/0062636 | A1 | * | 4/2004 | Mazzola et al. | 415/115 |
| 2005/0114082 | A1 | * | 5/2005 | Kant et al. | 702/183 |
| 2005/0274011 | A1 | * | 12/2005 | Ouellette et al. | 29/889.7 |
| 2006/0275112 | A1 | * | 12/2006 | Lee et al. | 415/191 |
| 2008/0063520 | A1 | * | 3/2008 | Baumann et al. | 415/209.3 |
| 2008/0213098 | A1 | * | 9/2008 | Neef et al. | 416/223 A |
| 2010/0135813 | A1 | * | 6/2010 | Marini et al. | 416/223 R |
| 2011/0091327 | A1 | * | 4/2011 | Willett, Jr. | 416/235 |
| 2012/0087781 | A1 | * | 4/2012 | Metscher | 415/174.4 |

FOREIGN PATENT DOCUMENTS

| | | | |
|---|---|---|---|
| GB | 710938 | A | 8/1954 |
| GB | 733918 | A | 7/1955 |
| GB | 946794 | A | 1/1964 |
| GB | 1491556 | A | 11/1977 |

* cited by examiner

GUIDE VANE WITH A WINGLET FOR AN ENERGY CONVERTING MACHINE AND MACHINE FOR CONVERTING ENERGY COMPRISING THE GUIDE VANE

CROSS REFERENCE TO RELATED APPLICATIONS

This application is the US National Stage of International Application No. PCT/EP2010/062234, filed Aug. 23, 2010 and claims the benefit thereof. The International Application claims the benefits of European application No. 09015576.3 EP filed Dec. 16, 2009. All of the applications are incorporated by reference herein in their entirety.

FIELD OF INVENTION

The present invention relates to a guide vane for an energy converting machine, in particular to a compressor or a turbine, wherein the guide vane comprises a winglet. Further, the present invention relates to a machine for converting energy, in particular a compressor or a turbine, including the guide vane having the winglet.

BACKGROUND OF INVENTION

From a flowing fluid having potential energy (pressure head) and kinetic energy (velocity head) energy may be extracted and may be converted by a turbine to mechanical energy, such as rotational energy, using a turbine. The extracted rotational energy may for example be used to drive a generator to generate electric energy.

Gas turbines comprise a compressor for compressing air which is then mixed with fuel and burned in a combustion chamber. The hot combustion gases are then expanded through a turbine providing a mechanical energy that can be used to drive an external apparatus, such as a electrical generator, a compressor or a pump.

Compressors may also be used to compress a gas to be used in industrial processes or to pump natural gas in a pipeline.

The compressor comprises a rotor shaft which is rotatably supported within a casing. Within the casing, the rotor shaft typically is supported by a bearing comprising plural pad bearings. Plural rotor blades are connected to the rotor shaft and extend radially outwards from the rotor shaft. The rotor shaft rotates around a rotation axis oriented in an axial direction driven by the mechanical energy provided to the compressor, for example by a turbine further downstream sharing the shaft with the compressor. The rotation of the rotor shaft drives the gas through the compressor towards a higher pressure. At a particular axial position along the rotation axis plural rotor blades may be connected to the rotor shaft forming a row of rotor blades. Plural rows of rotor blades may be connected to the rotor shaft at axial positions spaced apart from each other.

For appropriately guiding the streaming gas to the rotor blades a row of guide vanes is arranged downstream of a row of rotor blades, wherein the guide vanes are fixedly connected to the casing of the compressor. Thereby, the casing belongs to the stator part of the compressor. Thus, the guide vanes remain at rest, while the rotor blades rotate relative to the guide vanes and also relative to the casing. Further, the compressor may comprise a row of inlet guide vanes upstream the first row of rotor blades.

The guide vanes extend radially inwards towards the rotating rotor shaft. Thereby, a gap is formed between a radially inner end of the guide vanes and the rotor shaft. The streaming gas delivered by the rotor blade impinges onto an upstream or pressure surface, typically concave surface, of the guide vane and flows along the upstream surface and also along a downstream or suction surface of the guide vane to be directed to a rotor blade, respectively a row of rotor blades, downstream the guide vane, respectively the row of guide vanes. Since the pressure of the impinging gas is higher at the upstream surface of the guide vane than at the downstream surface of the guide vane, the upstream side of the guide vane is also called pressure side of the guide vane and the downstream side of the guide vane is also called the suction side of the guide vane. Because of the pressure difference between the pressure side and the suction side of the guide vane the impinging gas partially flows through the gap between the radially inner end of the guide vane and the rotor shaft from the pressure side of the guide vane to the suction side of the guide vane, thereby impairing the efficiency of the compressor.

In order to diminish the flow of the streaming gas from the pressure side to the suction side of the guide vane, the gap between the radially inner end of the guide vane and the rotor shaft has to be constructed as small as possible. However, due to thermal expansion during operation of the compressor which expansion is different for different components of the compressor, the gap may not be constructed too small. Instead, a particular running clearance between the radially inner end of the guide vane and the rotor shaft must be maintained.

From the document US 2008/0213098 A1 a blade for a turbo machine is known, wherein the blade has a blade tip which is curved in relation to the blade airfoil profile.

From the document GB 710938 a rotor blade for an axial flow fluid machine is known, wherein a stiffened plate is provided at a tip of the rotor blade.

From the document GB 1 491 556 a rotor blade for turbo machines is known, wherein the blade carries a tip plate which projects therefrom on the leading and/or trailing side.

From the document GB 733,918 a blade of elastic fluid turbines is known, wherein a small plate is fastened onto the top surface of the blade tip.

SUMMARY OF INVENTION

Currently, the means for reducing the running clearance and hence minimizing leakage from the pressure side to the suction side of the guide vane is to finish the guide vane tip length with a final assembly machining operation. This final assembly machine operation however is very cumbersome and dangerous, since it involves deburring partially by hand that introduces final machining debris contamination. The debris contamination impairs internal seals and requires an additional cleaning step. Further, the final assembly machining operation is very cost-intensive.

There may be a need for providing a guide vane having an improved performance when used in an energy converting machine, in particular a compressor or a turbine, and which can be more easily assembled into an energy converting machine, such as a compressor or a turbine. Further, there may be a need to improve a performance and efficiency of an energy converting machine, such as a compressor or a turbine, and also to reduce the costs of an energy converting machine. Further, maintainability of an energy converting machine may need to be improved.

This objective is achieved by the independent claims. The dependent claims describe advantageous developments and modifications of the invention.

According to an aspect of the invention, a guide vane for an energy converting machine is provided, wherein the guide vane comprises a guide vane body for guiding a streaming fluid, the guide vane body having an upstream or pressure surface and a downstream or suction surface; and a winglet for reducing leakage of the streaming fluid from the upstream surface to the downstream surface, wherein the winglet is arranged at a longitudinal end—particulary a tip of the guide vane—of the guide vane body. The winglet is arranged at the upstream surface of the guide vane body, particularly the winglet is arranged entirely at the upstream surface of the guide vane body.

The energy converting machine may be a compressor, particularly of a gas turbine engine, or a turbine.

The winglet particularly may be arranged between a leading edge and a trailing edge of the guide vane. The winglet may be a projection of the pressure surface limited to the pressure surface, thus having no projection or extension on the suction surface and no projection or extension beyond the leading edge or beyond the trailing edge.

If the chord length defines the length of the guide vane body between the leading edge and the trailing edge, the length of the winglet may also be limited to the chord length. The winglet may only be an expansion of the pressure surface but may not be a platform extending or surrounding the leading or trailing edges. As a consequence, once the guide vane is mounted in a compressor, during operation a fluid will be in contact first with the leading edge and later with the suction and pressure surfaces and surfaces of the winglet. The winglet will not be the first point of contact with the fluid because the winglet will not extend in upstream direction beyond the leading edge. In a same way, the winglet will not extend in downstream direction beyond the trailing edge. Therefore that the last point of contact with the fluid will be the trailing edge but not the winglet.

In other words, the extension of the winglet is limited between a first axisymmetric plane cutting through a rotor centre line and the leading edge and a second axisymmetric plane cutting through the rotor centre line and the trailing edge.

Considering the pressure surface is a concave surface having a first camber, the winglet may follow a less concave surface having a second camber which is less than the first camber.

Particularly the winglet may be a projection smoothly raising from the pressure surface starting from the leading edge and smoothly converging to the pressure surface at the trailing edge.

Furthermore the point of largest projection may be located substantially in the centre of the pressure surface between the leading edge and the trailing edge. Particularly the point of largest projection may not be near the leading edge and/or near the trailing edge.

In particular, the guide vane may be suitably shaped for guiding and compressing a gas to a combustor in a gas turbine. Thereby, a high pressure fluid or gas is provided by compression which can be burned in the combustor. The compression of the gas—particularly air—provided to the combustor, in there forming an air fuel mixture, is supplied by the guide vane which may have an aerofoil shape for guiding the streaming gas.

Alternatively, the guide vane may be suitably shaped for guiding exhaust gas of a combustor in a gas turbine. Thereby high temperature high pressure gas generated by burning a compressed air fuel mixture may be supplied to the guide vane.

According to the invention, longitudinal direction or longitudinal axis is defined as being a radial direction once the guide vane is assembled in a compressor, which may be substantially rotational symmetric about an axis of symmetry, the latter defining the centre for the radial direction. It may be the main direction of the trailing or the leading edges. Longitudinal end means one end of the guide vane body. The longitudinal end at which the winglet is present may be a tip of the guide vane body. A further longitudinal end without a winglet may be the end away from the tip at which the guide vane may be attachable to a stator, particularly a casing.

The guide vane may be particularly a variable guide vane, which is fixed to the casing such that an adjustment regarding an orientation around the longitudinal axis of the guide vane is enabled. The adjustment may take based on the rotational speed of the rotor and the load of the gas turbine engine.

The guide vane body has an upstream surface which may be a concave surface. The guide vane body has a downstream surface which may be a convex surface. When assembled into the energy converting machine, in particular a compressor, in operation the upstream surface of the guide vane body may be the surface of the guide vane body to which the streaming fluid is directed to and the downstream surface of the guide vane body may be the surface of the guide vane body opposite to the upstream surface. In operation the upstream surface may be located at the pressure side of the guide vane and the downstream surface may be located at the suction side of the guide vane. In particular, the downstream surface may comprise a larger area than the downstream surface. In a compressor the streaming gas may be decelerated along an axial direction when passing the guide vane comprised in the compressor.

The winglet is constructed and arranged such that leakage of the streaming fluid, in particular the streaming gas, from the upstream surface, typically a concave surface, to the downstream surface, typically a convex surface, of the guide vane body is reduced. The guide vane body may have a larger extent in a longitudinal direction than in a transverse direction orthogonal to the longitudinal direction. The winglet is arranged at a longitudinal end of the guide vane body. When mounted to the casing, the winglet may be the most radial inward end of the guide vane body, being opposite to a rotating part or the rotor itself.

The other longitudinal end of the guide vane body may be adapted to be mounted to a casing of a turbine such that the guide vane, when mounted to the casing, radially extends inwards towards a rotor shaft rotatably mounted within the casing.

Arranging the winglet at a longitudinal end of the guide vane body effectively diminishes leakage of the streaming fluid from the pressure side to the suction side of the guide vane via a tip of the guide vane, when the guide vane is assembled into the energy converting machine, in particular a compressor or a turbine, and when the energy converting machine is in operation.

In other words, the winglet is configured such that leakage of the streaming fluid from the upstream surface to the downstream surface of the guide vane body is reduced.

According to the invention the winglet is arranged at the upstream surface of the guide vane body. The upstream surface may be a concave surface. Providing the winglet at the upstream surface may even more effectively hinder the streaming fluid from flowing from a region close to the upstream surface around the longitudinal end of the guide vane body to a region close to the downstream surface, since the streaming fluid may more effectively be confined to the upstream side of the guide vane.

According to an embodiment the winglet protrudes transversely, in particular orthogonally, from the upstream surface of the guide vane body. By protruding transversely from the upstream surface of the guide vane body, the winglet may provide a barrier for the streaming fluid such that the streaming fluid may be hindered to freely flow without resistance from the upstream surface to the downstream surface along the longitudinal end of the guide vane body. Thus, over tip leakage of the fluid via the tip of the guide vane will be reduced. The downstream surface of the guide vane body may be a convex surface.

When assembled into an energy converting machine, in particular a compressor or a turbine, the longitudinal end of the guide vane body may correspond to a radially inner end of the guide vane. The amount of protrusion may depend on the application and/or machine type, such as longitudinal length of the guide vane, pressure and/or temperature of the streaming fluid, and a size of a clearance between the radially inner end of the guide vane and the rotor shaft rotating relative to the static guide vane. The guide vane may in particular be used in a compressor, since the pressure rise from one stage to the next stage of guide vanes may be low enough that leakage from the upstream surface of the guide vane to the downstream surface of the guide vane may effectively by reduced by the winglet.

According to an embodiment, the guide vane further comprises a downstream edge; and an upstream edge, wherein the winglet extends from the downstream edge to the upstream edge. The downstream edge and/or the upstream edge may at least approximately run along the longitudinal direction of the guide vane body. The winglet may in particular extend transversely to the downstream edge and/or to the upstream edge of the guide vane. In particular, the winglet may extend at least approximately orthogonally to the downstream edge and/or to the upstream edge. The upstream edge may also be called leading edge. The downstream edge may also be called trailing edge. The terms "leading" and "trailing" may be used in respect of a main fluid flow, i.e. the leading edge will be in contact first by the main fluid, the main fluid then will flow along the pressure and suction sides of the guide vane. The last point of contact with the main fluid will occur at the trailing edge of the guide vane.

Although in other embodiments the winglet may not extend across an entire region from the downstream edge to the upstream edge, but may extend for example only up to a portion of 50-70% of the entire region from the downstream edge to the upstream edge, it may be advantageous to construct the winglet such that it extends at least approximately across the entire region from the downstream edge to the upstream edge. Thereby, the winglet, especially when protruding transversely from the upstream surface, may comprise a larger area to form a barrier for the streaming fluid to diminish streaming from the upstream surface to the downstream surface.

According to a further embodiment, the winglet protrudes transversely from the upstream surface of the guide vane body with a protrusion dimension, wherein the protrusion dimension increases in a first region extending from the downstream edge of the guide vane body to an intermediate position of the guide vane body along a direction from the downstream edge of the guide vane body towards the intermediate position of the guide vane body and wherein the protrusion dimension decreases in a second region extending from the intermediate position to the upstream edge of the guide vane body along a direction from the intermediate position towards the upstream edge of the guide vane body. Thereby, the protrusion dimension may vary when proceeding from the downstream edge to the upstream edge such that the protrusion dimension may first increase to assume a maximum at an intermediate position, and such that the protrusion dimension may decrease when proceeding from the intermediate position to the upstream edge.

Particularly the protrusion dimension will increase continuously in the first region and the protrusion dimension will decrease continuously in the second region.

In particular, the intermediate position may correspond to a position where also the distance between the upstream surface and the downstream surface assumes at least approximately a maximum. At the intermediate position the barrier for the streaming fluid to diminish flowing from the upstream side to the downstream side may be more effective than further towards the upstream edge, respectively the downstream edge. Reducing the protrusion dimension towards the upstream edge, respectively the downstream edge, may save material to manufacture the winglet and may also save costs.

According to a further embodiment, the protrusion dimension at at least one position along a direction from the upstream edge towards the downstream edge amounts to between 0.5 and 1.5 times a distance between the upstream surface and the downstream surface of the guide vane body at the at least one position along the direction from the upstream edge towards the downstream edge. Thus, the protrusion dimension may depend on a thickness, i.e. a distance between the upstream surface and the downstream surface, of the guide vane body measured at at least one position along the direction from the upstream edge towards the downstream edge. In particular, the protrusion dimension at a position along the direction from the upstream edge towards the downstream edge may be proportional to a thickness of the guide vane body at this position. Further, the greater the thickness the greater may be the protrusion dimension at at least one position along the direction from the upstream edge towards the downstream edge.

According to an embodiment, the winglet has a thickness along a direction parallel to the upstream edge, wherein the thickness is less than 70%, in particular less than 40%, and more in particular less than 20%, of the protrusion dimension. In particular, the thickness may be as small as possible for optimized aerodynamic performance, as far as mechanical robustness and stability is maintained. Providing a smaller thickness may reduce required material to manufacture the winglet and also may reduce mass and costs of the guide vane.

According to a further embodiment the guide vane further comprises a longitudinal end surface, wherein the longitudinal end surface is at least partly formed by the winglet which is arranged at a longitudinal end of the guide vane. When the guide vane is assembled into a turbine the longitudinal end surface may be a radially inner surface of the guide vane facing the rotor shaft of the energy converting machine, in particular the rotor shaft of the compressor or turbine. A part of the longitudinal end surface may be formed by the winglet and a part of the longitudinal end surface may be provided by the guide vane body. In other embodiments the entire longitudinal end surface is formed by the winglet. The longitudinal end surface may for example be an at least approximately plane surface. Thereby aerodynamic performance may be improved.

According to a further embodiment the winglet comprises a transverse protrusion surface, wherein the transverse protrusion surface is oriented transverse to the upstream surface and forms an edge with the upstream surface. In particular, the transverse protrusion surface may include an angle with the upstream surface which may amount to between 40° and 130°, in particular in between 60° and 120°, more in particular in between 80° and 100°. The transverse protrusion surface may for example comprise a smooth surface, in particular a at least approximately plane surface.

The edge between the transverse protrusion surface and the upstream surface may run from the upstream edge to the downstream edge. The transverse protrusion surface may be adapted to effectively serve as a barrier for streaming fluid flowing from the upstream side to the downstream side along the longitudinal end surface.

According to a further embodiment an angle between a normal of the longitudinal end surface and an opposite of a normal of the transverse protrusion surface is less than 20°, in particular less than 10°, and more in particular less than 5°. In other words the longitudinal end surface and the transverse protrusion surface are inclined relative to each other by an angle of less than 20°, in particular less than 10°, and more in particular less than 5°.

Thereby, a thickness of the winglet along a direction parallel to the upstream edge of the winglet may be reduced, while at the same time a sufficient protrusion dimension is achieved.

According to a further embodiment the winglet further comprises a joining surface, wherein the joining surface joins the longitudinal end surface and the transverse protrusion surface. Assembled into a energy converting machine, in particular a compressor or a turbine, the joining surface may represent a component of the guide vane which is arranged farthest upstream. The joining surface may advantageously guide the streaming fluid impinging on the winglet for reducing leakage from the upstream side to the downstream side of the guide vane. The joining surface may be adapted as a small edge, in particular a round edge joining the transverse protrusion surface and the longitudinal end surface.

According to a further embodiment a blend radius between the longitudinal end surface and (a) the downstream surface of the guide vane body and/or (b) the joining surface of the winglet is less than 3 mm, in particular less than 1 mm. In particular the blend radius may be even smaller, such that at least approximately no blending is applied to edges between the longitudinal end surface and (a) the downstream surface of the guide vane body and/or (b) the joining surface of the winglet such that at least approximately sharp edges are formed. Thereby, aerodynamic performance may be improved.

According to a further embodiment a blend radius formed between the upstream surface of the guide vane body and the transverse protrusion surface of the winglet is less than 30 mm, in particular less than 10 mm, and more in particular less than 5 mm. The blend radius may be adapted such that aerodynamic performance is maintained and such that mechanical robustness is ensured. As far as these requirements are satisfied, the blend radius between the upstream surface and the transverse protrusion surface may be chosen as small as possible.

The above described embodiments may be used in any combination in a energy converting machine, in particular a compressor or a turbine, of any type and/or in a method for operating a energy converting machine, in particular a compressor or a turbine.

In the following, further exemplary embodiments of the energy converting machine, in particular the compressor, will be described. However, these embodiments also apply for the method for operating an energy converting machine, such as a compressor.

According to a further aspect, a machine for converting energy, in particular a compressor, is provided, wherein the machine for converting energy, in particular the compressor, comprises a casing; a guide vane according to an embodiment as defined in the previous sections, the guide vane being fixed at the casing; and a rotor shaft rotatably supported within the casing, wherein the guide vane extends inwards from the casing towards the rotor shaft.

The guide vane comprises the winglet at a longitudinal end of the guide vane body. This longitudinal end of the guide vane body may correspond to a radially inner surface of the guide vane when assembled into the machine for converting energy, wherein the radially inner surface of the guide vane faces a portion of the rotor shaft rotating relative to the static guide vane. The guide vane may be fixed at the casing via the other longitudinal end of the guide vane body. The guide vane may be a so-called fixed pitch guide vane or it may be a so-called variable pitch guide vane. A fixed pitch guide vane may be mounted at the casing such that it remains in a fixed orientation with respect to the longitudinal direction of the guide vane. In contrast, a variable pitch guide vane may be fixed to the casing such that a rotational adjustment regarding an orientation around the longitudinal axis of the guide vane is enabled. The orientation of the guide vane, for example represented by a rotation angle around its longitudinal axis, may be adapted depending on the application. Embodiments of the machine for converting energy, in particular a compressor or a turbine, may be equally applicable to a fixed pitch guide vane as well as to a variable pitch guide vane.

The guide vane may radially extend inwards from the casing towards the rotor shaft, wherein the winglet, respectively its longitudinal end surface, may face a portion of the rotor shaft. During operation streaming fluid may impinge onto the guide vane thereby generating higher pressure at the upstream side of the guide vane than on the downstream side of the guide vane. Due to the pressure difference between a region upstream of the upstream surface and a region downstream the downstream surface of the guide vane a portion of the fluid may tend to flow towards the radially inner end of the guide vane. Thereby, the winglet provided at the radially inner end of the guide vane may provide an effective barrier to reduce the flow of the fluid from the upstream side to the downstream side of the guide vane.

According to an embodiment, a gap greater than 0.5 mm, in particular greater than 0.6 mm, is formed between a radially inner surface of the guide vane and the rotor shaft. In particular, these values may apply to a compressor of a gas turbine considered to be in the small range for industrial applications. However, the principle tolerating a greater gap size than in a conventional compressor upon maintaining a similar efficiency may be applicable to gas turbines of varying scales. Further, the tip gap may vary according to compressor scale and other variables i.e. material coefficient of expansion, operation temperatures, predictions for relative displacement etc. Other types of compressors may require or allow either greater or smaller sizes of the gap. While in a conventional compressor this gap must be smaller in order to reduce leakage of the fluid from the upstream side to the downstream side, according to an embodiment this gap may be greater, compared to the conventional compressor, due to the diminished leaking caused by the winglet forming a barrier for the fluid. Thereby, manufacturing and assembly of the compressor may be simplified and may be performed more cost effective.

According to a further aspect, an energy converting machine in particular a compressor or a turbine, may be equipped with the inventive guide vane and may be operated. Such a method of operating an energy converting machine may comprise guiding a streaming fluid using a guide vane as defined in the previous sections, the guide vane being fixed at a casing and extending in a radial direction inwards from the casing; rotating a rotor around an axial direction orthogonal to the radial direction; and reducing leakage of the streaming fluid from an upstream surface of a guide vane body of the guide vane to a downstream surface of the guide vane body by arranging a winglet at a longitudinal end, in particular at the upstream surface, of the guide vane body.

Thereby, the method of operating the energy converting machine, in particular the compressor, may be improved regarding efficiency.

According to a further aspect, a method of manufacturing an energy converting machine, in particular a compressor or a turbine, may be provided, wherein a finished stock length guide vane is fixed at a casing and a rotor shaft is supported within the casing. The guide vane comprises a winglet at its radially inner end which faces the rotor shaft that allows to increase an operational clearance between the radially inner end of the guide vane and the rotor shaft. Thus, a final machining operation of the guide vanes may not be necessary and may be eliminated.

With the use of a winglet on the pressure side of the guide vane tip it may theoretically be possible to trade off leakage (losses) associated with a nominally shorter guide vane. Further, machining debris contamination may be avoided. Also, maintenance may be improved, as of the shelf guide vane may be interchanged rapidly. Further, health and safety may be improved, since debur operation post-machining being notorious for cutting hands and wrist may be avoided or at least diminished.

It has to be noted that embodiments of the invention have been described with reference to different subject matters. In particular, some embodiments have been described with reference to method type claims, whereas other embodiments have been described with reference to apparatus type claims. However, a person skilled in the art will gather from the above and the following description that, unless otherwise notified, in addition to any combination of features belonging to one type of subject matter also any combination between features relating to different subject matters, in particular between features of the method type claims, and features of the apparatus type claims, is considered as to be disclosed with this document.

The aspects defined above and further aspects of the present invention are apparent from the examples of embodiment to be described hereinafter and are explained with reference to the examples of embodiment. The invention will be described in more detail hereinafter with reference to examples of embodiment, but to which the invention is not limited.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

It should also be noted that the terms upstream surface and pressure surface will be regarded synonyms throughout this document. The same is true for downstream surface and suction surface.

BRIEF DESCRIPTION OF THE DRAWINGS

Embodiments will be described with reference to the accompanying drawing to which the invention is not limited.

DETAILED DESCRIPTION OF INVENTION

Figure 1:
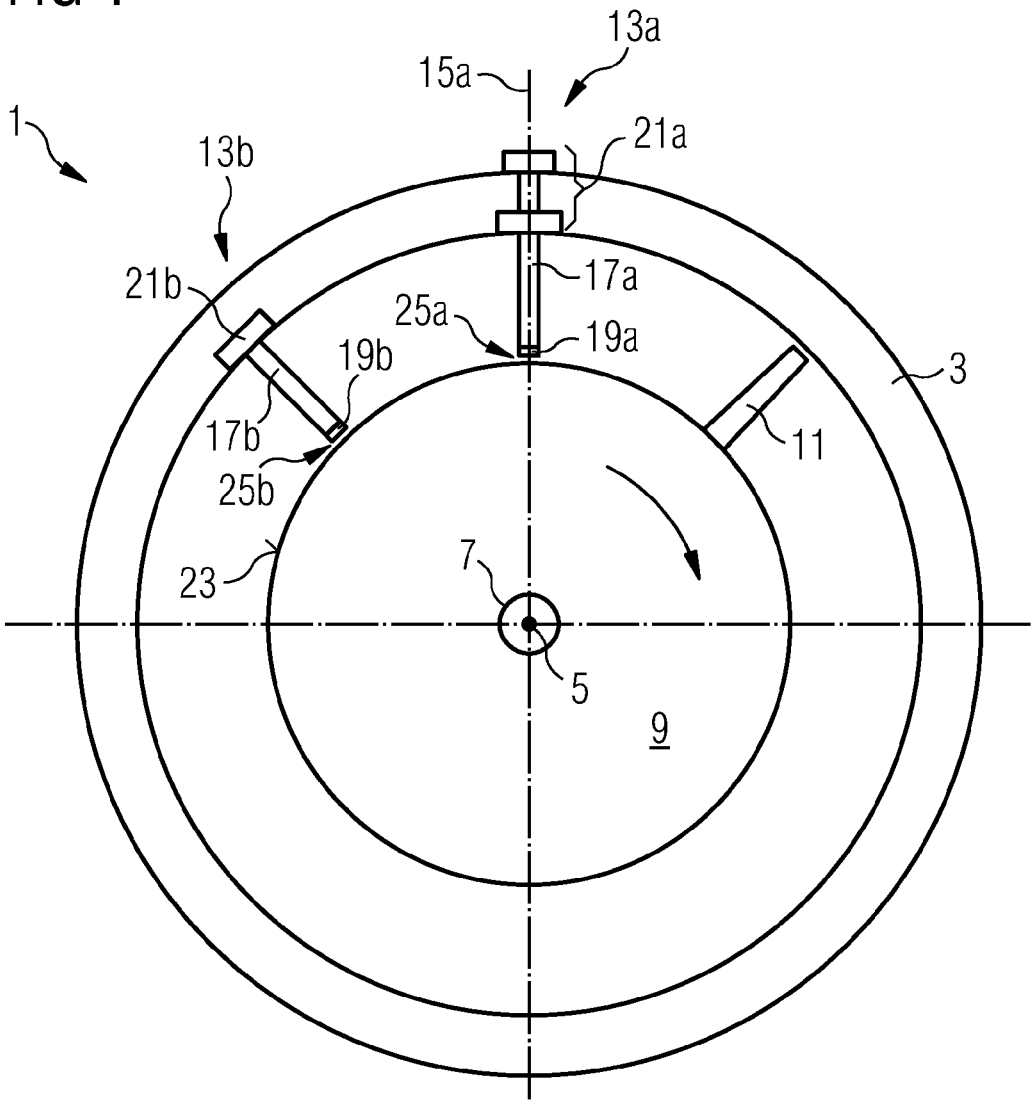
FIG. 1 shows a schematic sectional view of a compressor according to an embodiment.

FIG. 1 schematically illustrates a sectional view along an axial direction of a compressor 1 according to an embodiment. The compressor 1 comprises a casing 3 which belongs to the stator part of the compressor. In the sectional view the casing has a circular shape. In the center 5 of the circle a rotation axis running along the axial direction perpendicular to the drawing plane of FIG. 1 is provided. A rotor shaft 7 is supported within the casing 3 such that the rotor shaft 7 can rotate around the rotation axis along the axial direction. Connected to the rotor shaft 7 is a rotor 9 to which a plurality of rotor blades 11 are fixed from which only one rotor blade 11 is exemplarily illustrated in FIG. 1. The compressor 1 may comprise further rotor blades 11.

A high velocity gas is supplied to the compressor 1 using at least one not illustrated entry duct along the axial direction.

For guiding the streaming fluid to or receiving the streaming fluid from the rotor blade(s) 11 the compressor 1 may comprise plural guide vanes of which only two guide vanes 13*a* and 13*b* are illustrated in FIG. 1. The guide vanes 13*a* and 13*b* are of the different type. Guide vane 13*a* is a so-called variable pitch guide vane which allows adjustment of an angle of incidence of the streaming fluid by mounting the guide vane 13*a* at the casing 3 such that a setting angle may be adjusted by rotating the guide vane 13*a* around a longitudinal axis 15*a* of the guide vane 13*a*. For this purpose, the guide vane 13*a* comprises a guide vane mounting portion 21*a* which is adapted to mount the guide vane 13*a* rotatably around the longitudinal axis 15*a* at the casing. The guide vane 13*a* further comprises a guide vane body 17*a* extending in a radial direction perpendicular to the axial direction of the rotation axis 5 and providing an aerofoil shape for guiding the streaming fluid. Further, the guide vane 13*a* comprises at a radially inner end of the guide vane body 17*a* a winglet 19*a* which will be described in more detail below.

In contrast to the variable pitch guide vane 13*a* the compressor 1 may comprise instead or alternatively or additionally one or more fixed pitch guide vanes 13*b*. This is illustrated in the same FIG. 1 as well, even though in an implementation usually only fixed pitch guide vanes or only variable guide vanes will be equipped in one ring of vanes. The fixed pitch guide vane 13*b* comprises a guide vane mounting portion 21*b* which is used to fix the guide vane 13*b* at the casing 3 at a preset setting angle. Similar to the variable pitch guide vane 13*a*, the fixed pitch guide vane further comprises a guide vane body 17*b* and a winglet 19*b* arranged at a radially inner end of the guide vane body 17*b*. Between the radially inner end of the guide vanes 13*a* and 13*b*, respectively, and a radially outer surface 23 of the rotor 9 a gap 25*a* and 25*b*, respectively, is formed. According to an embodiment due to the arrangement of the winglet 19*a*, 19*b* at the radially inner end of the guide vane body 17*a*, 17*b* the gap 25*a*, 25*b* may be greater than a gap in a conventional compressor not having winglets at the radially inner ends of the guide vanes without impairing the efficiency of the compressor 1.

Embodiments provide different arrangements of guide vanes and different types of guide vanes assembled into the compressor 1. For example, all guide vanes may be fixed pitch guide vanes, such as guide vane 13*b* illustrated in FIG. 1; all guide vanes may be variable pitch guide vanes, such as guide vane 13*a* illustrated in FIG. 1; or some guide vanes may be fixed pitch guide vanes and some guide vanes may be variable pitch guide vanes. Further, the guide vanes may be arranged in one or more rows, wherein the rows may be spaced apart in an axial direction. Downstream and/or upstream from each row of guide vanes a row of rotor blades 11 comprising plural rotor blades may be arranged. Further, in the compressor there may be inlet guide vanes located upstream the first row of blades. A compressor stage may comprise a row of blades followed by a row of vanes. After the last row of blades there may be one or two subsequent rows of guide vanes called exit guide vanes.

Figure 2:
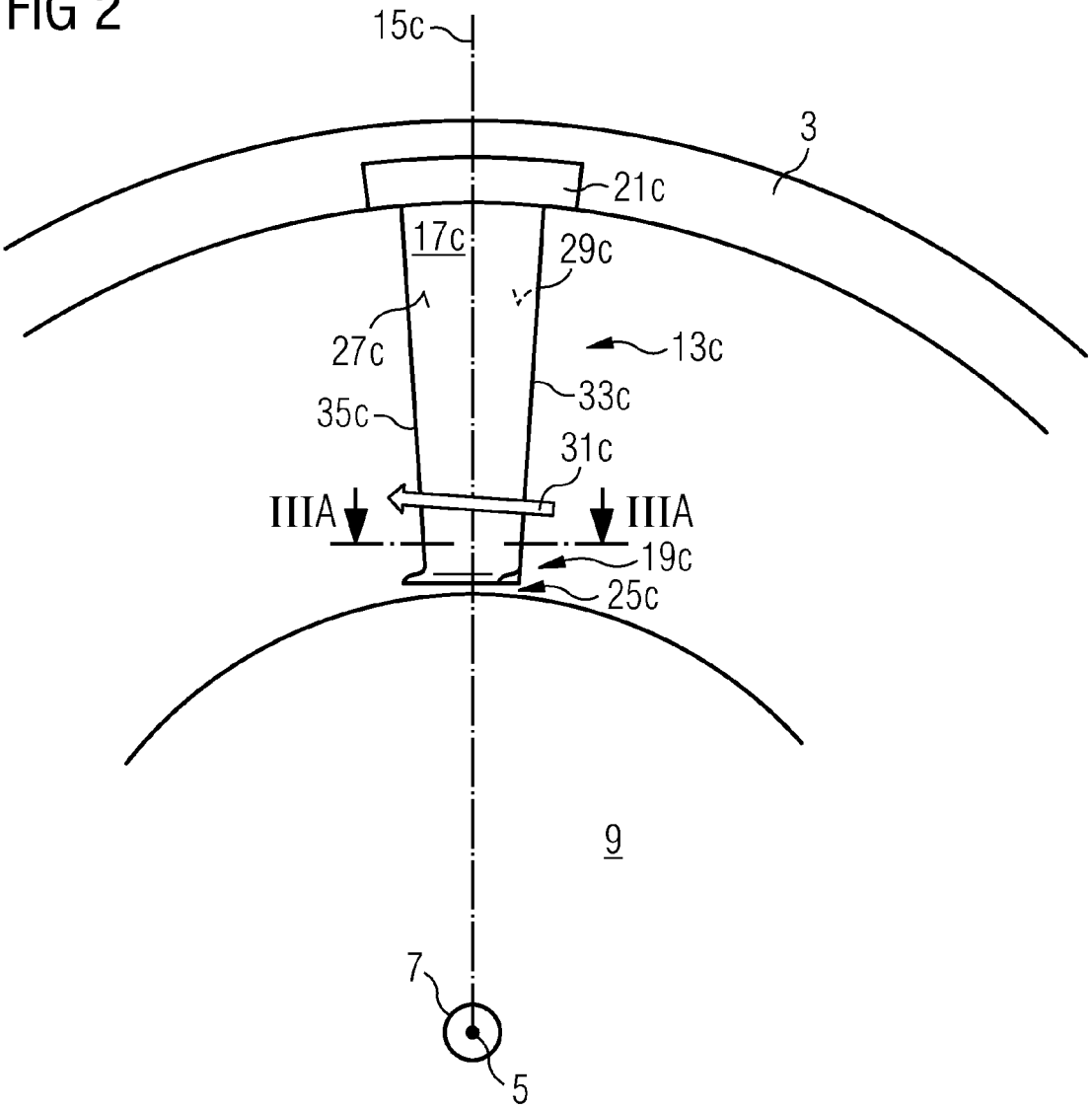
FIG. 2 schematically shows a guide vane according to an embodiment assembled into a compressor.

FIG. 2 schematically illustrates in a partially perspective view a guide vane 13*c* according to an embodiment as mounted at a casing 3. The guide vane 13*c* is a fixed pitch guide vane fixed to the casing 3 via the guide vane mounting portion 21*c*. In other embodiments the guide vane 13*c* may be a variable pitch guide vane.

A fixed pitch guide vane may be connected to the casing 3 non-rotatably. It may be permanently fixed and/or non-switched and/on firmly bonded and/or firmly attached.

The guide vane 13*c* comprises a guide vane body 17*c* for guiding the streaming fluid. For this purpose, the guide vane body 17*c* comprises an upstream surface 27*c* facing the observer of the FIG. 2 and a downstream surface 29*c* opposite to the upstream surface 27*c*. The upstream surface 27*c* has a concave shape and the downstream surface 29*c* has a convex shape. The streaming fluid flows having a component in the axial direction and having further a component in a direction labelled by the arrow 31*c*. At a joining portion of the upstream surface 27*c* and the downstream surface 29*c* an upstream edge 33*c* of the guide vane is formed at an upstream end and a downstream edge 35*c* is formed at a downstream end.

At a radially inner longitudinal end of the guide vane body with respect to a longitudinal axis 15*c* a winglet 19*c* is arranged. The winglet 19*c* is provided for reducing leakage of the streaming fluid from the upstream surface 27*c* to the downstream surface 29*c* during operation of the compressor. In the illustrated embodiment of the guide vane 13*c* the winglet 19*c* is arranged at the upstream surface 27*c*. In other embodiments the winglet may be provided at the downstream surface 29*c*. During operation the winglet 19*c* may hinder the streaming fluid to flow from a region upstream of the upstream surface 27*c* to a region downstream of the downstream surface 29*c* through the gap 25*c* between a radially inner end of the guide vane 13*c* and the rotor 9. Thereby, the efficiency of the compressor may be improved or a predetermined efficiency may be achieved for a larger gap 25*c* compared to a conventional guide vane having no winglet.

Figure 3A:
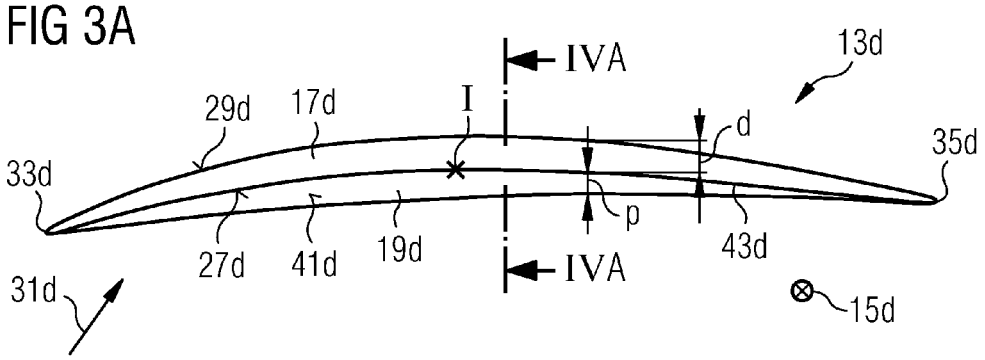
FIGS. 3A, 3B and 3C show schematic projections views along the longitudinal axis of the guide taken at line IIIA-IIIA in FIG. 2, of a guide vane or parts of a guide vane according to an embodiment.
Figure 3B:
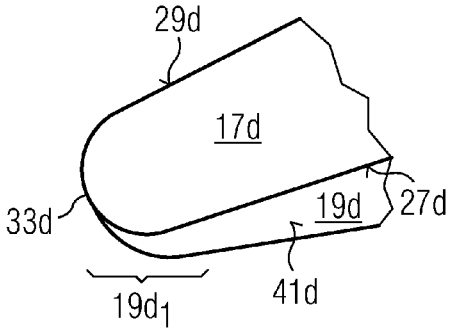
Figure 3C:
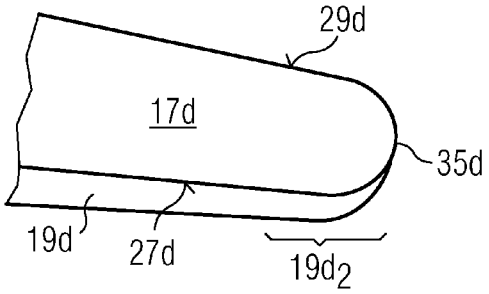

FIGS. 3A, 3B and 3C schematically illustrate projection views taken along the arrows at the line IIIA-IIIA in FIG. 2 of a guide vane or portions thereof according to an embodiment. When assembled into a compressor or turbine, the longitudinal axis being perpendicular to the drawing plane of FIGS. 3A, 3B and 3C would be the radial direction defined by the position where the guide vane is attached and fixed to the casing 3.

For example, the guide vanes 13*a*, 13*b*, 13*c* illustrated in FIGS. 1 and 2 may have projection views as illustrated in FIGS. 3A, 3B, 3C. However, in other embodiments projection views of the guide vanes 13*a*, 13*b* and 13*c* may be different from the views illustrated in FIGS. 3A, 3B, 3C.

As illustrated in the projection view of FIG. 3A, the guide vane 13*d* comprises a concave upstream surface 27*d* and a convex downstream surface 29*d*. An approximate direction of the streaming fluid is indicated by an arrow 31*d*. Approximately perpendicular to the drawing plane of FIG. 3A the guide vane 13*d* comprises an upstream edge 33*d* and a downstream edge 35*d* which are formed where the upstream surface 27*d* and the downstream surface 29*d* join. The projection view of FIG. 3A is taken close to a longitudinal end of the guide vane 13*d*. At the longitudinal end of the guide vane or close to this position the guide vane 13*d* comprises a winglet 19*d* which is arranged at the upstream surface 27*d* and which extends from the upstream edge 33*d* to the downstream edge 35*d*. Along a path 43*d* from the downstream edge 35*d* to the upstream edge 33*d* a protrusion dimension p increases from the downstream edge 35*d* to an intermediate position I and the protrusion dimension p decreases from the intermediate position I to the upstream edge 33*d*. Thereby, the winglet 19*d* protrudes transversely from the upstream surface 27*d* towards upstream.

A distance d between the upstream surface 27*d* and the downstream surface 29*d* varies along the path (edge) 43*d* from the downstream edge 35*d* to the upstream edge 33*d*. In particular, the thickness d increases from the downstream edge 35*d* to the intermediate position I and decreases from the intermediate position I to the upstream edge 33*d*. As can be seen from FIG. 3A, the protrusion dimension p amounts to between 0.5 and 1.5 times the distance d, when the protrusion dimension p and the distance d are measured at the same position on path 43*d*.

FIG. 3B schematically illustrates a portion of the projection view of FIG. 3A close to the upstream edge 33*d*. As can be seen a shape of a portion 19*d*1 of the winglet 19*d* close to the upstream edge 33*d* smoothly blends into the aerofoil profile defined by the shapes of the upstream surface 27*d* and the downstream surface 29*d* and in particular defined by the shape of the edge 33*d* where the upstream edge 27*d* and the downstream surface 29*d* join each other.

Similarly, as illustrated in FIG. 3C, a shape in a region 19*d*2 of the winglet 19*d* smoothly blends into a shape of the downstream edge 35*d* joining the upstream surface 27*d* and the downstream surface 29*d*. Thereby, an aerodynamic performance may be improved.

Other embodiments of a guide vane may have differently shaped winglets.

Figure 4A:
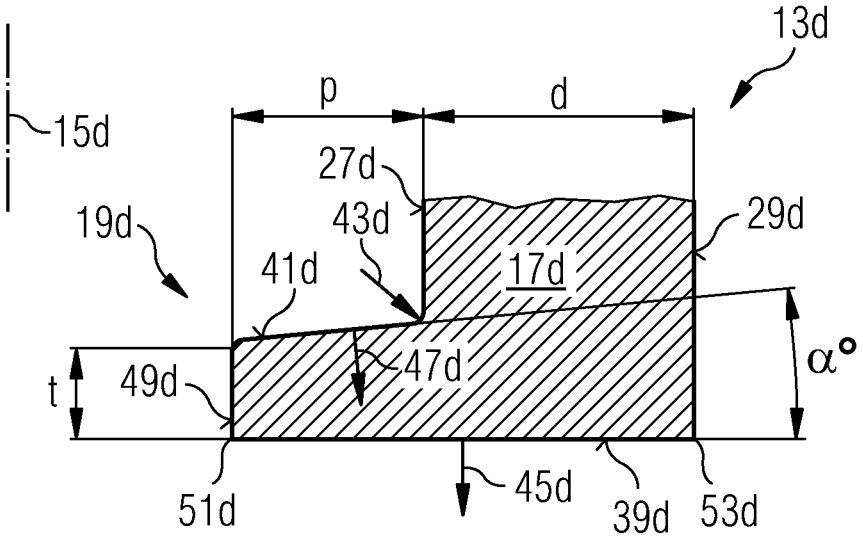
FIG. 4A schematically shows a cross-section of a guide vane taken along line IVB-IVB in FIG. 3A according to an embodiment.

FIG. 4A schematically illustrates a cross-sectional view taken along the line IVA-IVA in FIG. 3A. The longitudinal axis 15*d* runs vertically in the drawing plane. In the sectional view of FIG. 4A the upstream surface 27*d* and the downstream surface 29*d* run approximately vertically having a distance d from each other. Also indicated is the protrusion dimension p which amounts to between 0.5 to 1.5 times the distance d. Further, a direction parallel to the upstream edge runs approximately vertically in FIG. 4A. A thickness t of the winglet 19*d* along the direction parallel to the upstream edge amounts to less than 70%, particular less than 40%, more in particular less than 20% of the protrusion dimension p.

The guide vane 13*d* further comprises at a longitudinal end surface 39*d* which at least approximately is orthogonally oriented with respect to the downstream surface 29*d* and the upstream surface 27*d*. When assembled into the compressor or the turbine, the longitudinal end surface 39*d* may face a portion of the rotor shaft 7 or a portion of the rotor 9. The longitudinal end surface may at least partially be formed by the winglet 19*d*, but may also be partially formed by the guide vane body 17*d*.

The winglet comprises a transverse protrusion surface 41*d* which is oriented transverse to the upstream surface 27*d* and which forms an edge 43*d* with the upstream surface 27*d*.

An angle between a normal 45*d* of the longitudinal end surface 39*d* and an inverse 47*d* of a normal of the transverse protrusion surface 41*d* may be less than 20°, in particular less than 10°, more in particular less than 5°. This angle may be even smaller to improve an aerodynamic performance.

The winglet further comprises a joining surface 49*d* which joins the transverse protrusion surface 41*d* and the longitudinal end surface 39*d*. Between the longitudinal end surface 39*d* and (a) the joining surface 49*d* and (b) the downstream surface 29*d* edges 51*d* and 53*d*, respectively, are formed which may have no blending to form sharp edges. The edge 43*d* between the upstream surface 27*d* and the transverse protrusion surface 41*d* may have a blend radius which may be minimized for an aerodynamic performance at the same time providing the required mechanical robustness.

Figure 4B:
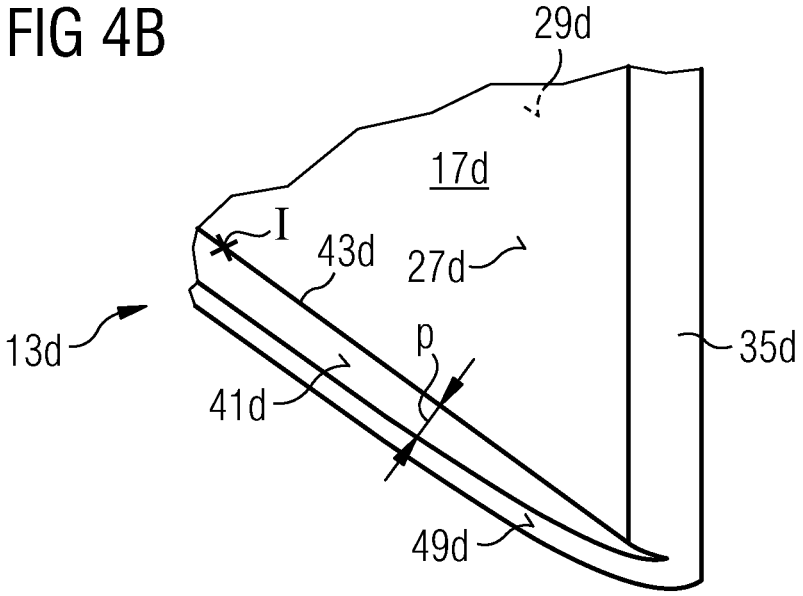
FIG. 4B shows a schematic perspective view of a portion of a guide vane according to an embodiment.

FIG. 4B schematically illustrates a portion of a guide vane according to an embodiment in a perspective view. As can be observed the joining surface 49*d* smoothly blends with a shape of the downstream edge 35*d*, wherein the protrusion dimension p decreases from the intermediate position I along the edge 43*d* from the not illustrated upstream edge 33*d* to the downstream edge 35*d*.

In all embodiments, the guide vane body and the winglet may particularly be produced as one single piece. Alternatively, the guide vane body and the winglet may be manufactured as separate pieces and later being assembled.

Furthermore, the implementation is particularly applicable to variable guide vanes of a compressor within a gas turbine engine.

There may be reasons that this implementation may also be used in different kind of machines, in the turbine section of a gas turbine engine, of for rotating blades within one of these configurations.

The invention claimed is:

1. A machine for converting energy, comprising:

a casing;

a guide vane being fixed at the casing;

a rotor shaft rotatably supported within the casing for rotating the rotor around an axial direction orthogonal to a radial direction;

wherein the guide vane extends inwards from the casing towards the rotor shaft;

the guide vane comprising:

a guide vane body for guiding a streaming fluid, the guide vane body having a pressure surface and a suction surface; and a winglet for reducing leakage of the streaming fluid from the pressure surface to the suction surface, a trailing edge; and a leading edge;

wherein the winglet extents from the trailing edge to the leading edge, wherein the winglet is arranged at a longitudinal end of the guide vane body, and wherein the winglet is arranged at the pressure surface, wherein the winglet is free of protrusions beyond the leading edge and beyond the trailing edge, wherein the longitudinal end of the guide vane body corresponds to a radially inner end of the guide vane, wherein the winglet protrudes transversely from the pressure surface of the guide vane body with a protrusion dimension, wherein the protrusion dimension measured at a position along the direction from the leading edge towards the trailing edge depends on a thickness of the guide vane body at the position, the thickness being a distance between the pressure surface and the suction surface of the guide vane body, wherein the distance between the pressure surface and the suction surface varies along a path from the trailing edge to the leading edge, wherein the greater the thickness the greater the protrusion dimension, wherein the protrusion dimension increases in a first region extending from the trailing edge of the guide vane body to an intermediate position of the guide vane body along a direction from the trailing edge of the guide vane body towards the intermediate position of the guide vane body, wherein the protrusion dimension decreases in a second region extending from the intermediate position to the leading edge of the guide vane body along a direction from the intermediate position towards the leading edge of the guide vane body, and wherein the protrusion dimension at any given position along a direction from the leading edge towards the trailing edge amounts to between 0.5 and 1.5 times the thickness of the guide vane body at the given position along the direction from the leading edge towards the trailing edge, and wherein the winglet has a thickness along a direction parallel to the leading edge, wherein the thickness is less than 70% of the protrusion dimension.

2. The machine according to claim 1, wherein the winglet protrudes orthogonally from the pressure surface of the guide vane body.

3. The machine according to claim 1, wherein the thickness less than 40% of the protrusion dimension.

4. The machine according to claim 3, wherein the thickness less than 20% of the protrusion dimension.

5. The machine according to claim 1, wherein the guide vane further comprises:

a longitudinal end surface, wherein the longitudinal end surface is at least partly formed by the winglet which is arranged at the longitudinal end of the guide vane.

6. The machine according to claim 5, wherein the winglet comprises:

a transverse protrusion surface, wherein the transverse protrusion surface is oriented transverse to the pressure surface and forms an edge with the pressure surface.

7. The machine according to claim 6, wherein an angle between the longitudinal end surface and the transverse protrusion surface is less than 20°.

8. The machine according to claim 7, wherein the angle is less than 10°.

9. The machine according to claim 8, wherein the angle is less than 5°.

10. The machine according to claim 6, wherein the winglet further comprises:

a joining surface, wherein the joining surface joins the longitudinal end surface and the transverse protrusion surface.

11. The machine according to claim 10, wherein a blend radius between the longitudinal end surface and a) the suction surface of the guide vane body, and/or b) the joining surface of the winglet is less than 3 mm.

12. The machine according to claim 7, wherein a blend radius formed between the pressure surface of the guide vane body and the transverse protrusion surface of the winglet is less than 30 mm.

13. The machine according to claim 12, wherein the blend radius is less than 10 mm.

14. The machine according to claim 13, wherein the blend radius is less than 5 mm.

15. The machine according to claim 1, wherein a gap greater than 0.5 mm is formed between a radially inner surface of the guide vane and a rotor fixed at the rotor shaft.

16. The machine according to claim 15, wherein said gap is greater than 0.6 mm.

17. The machine according to claim 1, wherein a portion of the winglet close to the leading edge smoothly blends into an airfoil profile defined by the shapes of the upstream surface and the downstream surface and further defined by the shape of the leading edge.

18. The machine according to claim 1, wherein, the thickness of the guide vane body increases from the trailing edge to the intermediate position and decreases from the intermediate position to the leading edge.

* * * * *